US008875478B2

(12) United States Patent
Fitzgerald, IV et al.

(10) Patent No.: US 8,875,478 B2
(45) Date of Patent: Nov. 4, 2014

(54) METHOD AND APPARATUS FOR FORMING AND FILLING A FLEXIBLE PACKAGE

(75) Inventors: Matthew Louis Fitzgerald, IV, Town of Tomhannock, NY (US); Thomas Stemper, Clifton, NY (US)

(73) Assignee: Momentive Performance Materials Inc., Waterford, NY (US)

( * ) Notice: Subject to any disclaimer, the term of this patent is extended or adjusted under 35 U.S.C. 154(b) by 733 days.

(21) Appl. No.: 12/701,531

(22) Filed: Feb. 6, 2010

(65) Prior Publication Data

US 2010/0139217 A1 Jun. 10, 2010

(51) Int. Cl.
*B65B 43/04* (2006.01)
*B65B 5/02* (2006.01)

(52) U.S. Cl.
USPC ..... 53/455; 53/450; 53/452; 53/559; 53/562

(58) Field of Classification Search
USPC ..... 53/455, 412, 410, 450, 452, 562, 548
See application file for complete search history.

(56) References Cited

U.S. PATENT DOCUMENTS

| | | | | | |
|---|---|---|---|---|---|
| 2,547,835 | A * | 4/1951 | Pfeiffer | 53/397 |
| 3,114,298 | A | 12/1963 | Boone | |
| 4,216,639 | A * | 8/1980 | Gautier | 53/413 |
| 4,252,052 | A | 2/1981 | Meyers et al. | |
| 4,453,370 | A * | 6/1984 | Titchenal | 53/455 |
| 5,181,365 | A | 1/1993 | Garvey et al. | |
| 5,353,573 | A * | 10/1994 | Durrant | 53/410 |
| RE35,067 | E | 10/1995 | Bauknecht | |
| 5,524,418 | A | 6/1996 | Thompson | |
| 5,699,653 | A | 12/1997 | Hartman | |
| 5,816,019 | A * | 10/1998 | Saget et al. | 53/373.9 |
| 5,941,052 | A * | 8/1999 | Evangelisti | 53/433 |
| 5,966,907 | A * | 10/1999 | Julius | 53/450 |
| 6,148,588 | A * | 11/2000 | Thomas et al. | 53/412 |
| 6,195,967 | B1 | 3/2001 | Todd et al. | |
| 6,216,424 | B1 * | 4/2001 | Yoshida | 53/412 |
| 6,237,308 | B1 * | 5/2001 | Quintin et al. | 53/451 |
| 6,342,123 | B1 * | 1/2002 | Rees et al. | 156/282 |
| 6,381,919 | B2 | 5/2002 | Todd et al. | |
| 6,393,809 | B2 * | 5/2002 | Todd et al. | 53/562 |
| 6,871,476 | B2 * | 3/2005 | Tobolka | 53/374.2 |
| 6,976,946 | B2 | 12/2005 | Wied et al. | |
| 7,406,810 | B2 * | 8/2008 | Clune et al. | 53/412 |
| 7,424,796 | B2 * | 9/2008 | Shepard et al. | 53/452 |
| 7,581,765 | B2 * | 9/2009 | Minford | 285/364 |
| 7,908,829 | B2 * | 3/2011 | Ligon et al. | 53/511 |
| 8,117,805 | B2 * | 2/2012 | Ligon et al. | 53/433 |
| 8,128,546 | B2 * | 3/2012 | Dytchkowskyj et al. | 493/214 |
| 2001/0010142 | A1 * | 8/2001 | Todd et al. | 53/64 |
| 2005/0060960 | A1 * | 3/2005 | Sperry et al. | 53/450 |
| 2007/0199280 | A1 * | 8/2007 | Thomas et al. | 53/412 |
| 2008/0313998 | A1 * | 12/2008 | Ligon et al. | 53/455 |
| 2009/0127323 | A1 * | 5/2009 | Zeiler et al. | 229/116 |
| 2010/0011710 | A1 * | 1/2010 | Pape | 53/450 |

* cited by examiner

*Primary Examiner* — Hemant M Desai
*Assistant Examiner* — Gloria R Weeks
(74) *Attorney, Agent, or Firm* — Joseph E. Waters

(57) ABSTRACT

A flexible package is formed and filled in an in-line process by directing a web of film and a semi-rigid strip in a machine direction; folding the web of film into a pair of opposing walls with the semi-rigid strip there between; and selectively attaching the strip to only one of the opposing walls by controlling applied heating to opposing walls of the pair to seal one wall but not the other to the semi-rigid strip to define an opening between upper edges of the opposing walls.

17 Claims, 6 Drawing Sheets

METHOD AND APPARATUS FOR FORMING AND FILLING A FLEXIBLE PACKAGE

This application claims the benefit of U.S. application Ser. No. 12/361,887 filed Jan. 29, 2009.

BACKGROUND OF THE INVENTION

The invention relates to a method and apparatus for forming and filling a flexible package in which a continuous web of material is converted into a plurality of individual pouches. The continuous web of material is folded in half over a plow to form two continuous side panels joined by a bottom fold. The folded web is passed through a series of seal bars that form transverse seals between side panels, thereby forming a strip of pouches interconnected by transverse seals. Either before or after filling, a cutter cuts through each transverse seal to form individual pouches with unsealed top edges. The pouches are transferred to a pouch filler, filled with product, and sealed. The sealed pouches are then collected for transport. Apparatus of this type may be categorized as horizontal or vertical machines, depending on the general direction of web travel.

Gautier U.S. Pat. No. 4,216,639 discloses an in-line method and apparatus for forming a pouch having two sealed pockets. Copending applications assigned to Momentive Performance Materials (MPM) Sharp et al. Ser. No. 12/236,555 filed Sep. 24, 2008; Sharp et al. Provisional Application 61/104,818 filed Oct. 13, 2008 and Fitzgerald Ser. No. 12/361,887 filed Jan. 29, 2009 disclose flexible packages that comprises a semi-rigid flat that cradles a pouch. Other MPM applications Sharp et al. Ser. No. 11/613,661 filed Dec. 20, 2006; Sharp et al. Ser. No. 12/200,376 filed Aug. 28, 2008 and design application Ser. No. 29/325,455 disclose further versions of tillable and expressible pouch packages. The MPM pouches are expandable at an edge for filling. Also, in use, the semi-rigid pouch can be folded or rolled to compress a cradled pouch to express content through an expressing shaped closure end. There is a need for an in-line method and apparatus to form pouches for these flexible package types.

BRIEF DESCRIPTION OF THE INVENTION

The invention provides an on-line method and apparatus to form and fill a flexible package that comprises a method of forming and filling a flexible package using an in-line process, the method comprising: directing a web of film and a semi-rigid strip in a machine direction; folding the web of film into a pair of opposing walls with the semi-rigid strip there between; and selectively attaching the strip to only one of the opposing walls by controlling applied heating to opposing walls of the pair to selectively seal one wall but not the other to the semi-rigid strip to define an opening between upper edges of the opposing walls.

In an embodiment, an apparatus for forming and filling a flexible package comprises: a film unwind station for unwinding a web of flexible film from a roll of film; a folding station for folding the web into a pair of opposing walls; a strip unwind station for unwinding a strip of semi-rigid material from a roll of material and positioning the strip between the pair of opposing walls of the web; and a sealing station having a temperature controlled sealing bar to selectively seal one of the opposing walls with the strip but not the other walls.

In another embodiment, a method of forming and filling a squeezable package, the method comprises: directing a web of flexible film and a semi-rigid strip in a machine direction; folding the web of film to have a pair of opposing walls having a front wall and a back wall and positioning the strip between the front and back wall; adjusting temperature, pressure and dwell time to selectively seal one opposing wall to the strip but not the other to form an opening; forming a lower non-linear side seal between the opposing walls in the web of flexible film; forming an upper non-linear side seal between the opposing walls in the web of flexible film partially coextensive with the lower side seal; removing a first non-linear section in a lower portion of the web of film to provide multiple pouches connected at an upper portion thereof; separating the connected pouches from the web of film at the upper portion to provide an individual pouch with an upper opening; filling an interior section of the individual pouch through the opening in the upper portion of the pouch with a flowable material; forming a top seal to close the opening; and removing a second non-linear section in the upper portion of the pouch to form the squeezable package having a narrower upper portion than lower portion.

BRIEF DESCRIPTION OF THE DRAWING

FIGS. 2 to 6A to 6B are schematic views of stages or stations of the apparatus of FIG. 1;

DETAILED DESCRIPTION OF THE INVENTION

Figure 1:
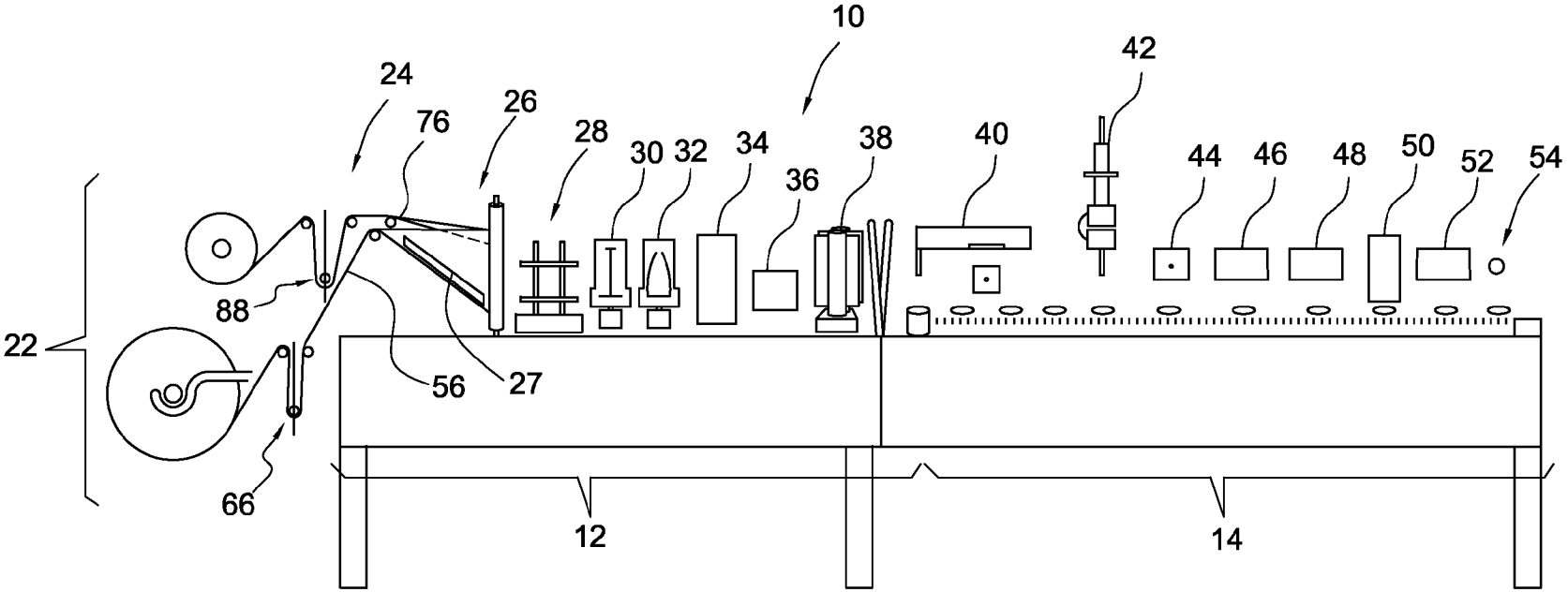
FIG. 1 is a schematic elevation of an apparatus for forming and filling a flexible package.

The term "sealant" as used herein includes an entire variety of caulks including silicones, latex and acrylic caulk; filler compounds; adhesive or mastic-type materials, such as stucco, concrete and cementious-material patching and crack filling compounds; gasketing compounds; gutter, flashing, skylight, or fish tank seam or sealant compounds; butyl or rubber sealants, cements and caulk; roof cements; panel and construction adhesives; glazing compounds and caulks; gutter and lap sealants; silica gel-based firebrick, masonry and ceramic crack fillers and cements; silicone based glues; ethylene glycol-containing latex glazing compounds; and the like.

One preferred sealant is an organopolysiloxane room temperature vulcanizable (RTV) composition. The room temperature vulcanizable silicone elastomer composition can contain a silanol stopped base polymer or elastomer, reinforcing and/or extending filler, cross-linking silane and cure catalyst. These RTV compositions are prepared by mixing diorganopolysiloxanes having reactive end groups with organosilicon compounds that possess at least three hydrolyzably reactive moieties per molecule. The known RTV compositions are widely used as elastic sealing materials for applications involving the gaps between various joints such as: gaps between the joints of structures; joints between structural bodies and building materials in buildings; gaps between a bathtub and wall or floor; cracks on tiles in bathrooms; gaps in the bathroom such as those around a washbasin and those between a washbasin supporting board and a wall; gaps around a kitchen sink and the vicinity; spacings between panels in automobiles, railroad vehicles, airplanes and ships; gaps between prefabricated panels in various electric appliances, machines; and the like. Room temperature vulcanizable silicone sealants thus may be utilized in a wide variety of caulking and sealing applications.

Publication US200803 13998 discloses an in-line method and system to form and fill a flexible package compatible with a selected fill. The method comprises: directing a web of film and a semi-rigid strip in a machine direction; folding the web of film to have a pair of opposing walls with the semi-rigid strip there between; attaching the strip to one of the opposing walls using a metal buffer plate; sealing the opposing walls of the web of film together at spaced sealing regions to form pouches between the sealing regions; removing a section of the sealing regions at a lower portion to provide multiple pouches connected at an upper portion; separating the connected pouches from the web of film to provide an individual pouch; filling an interior section of the individual pouch through an opening in the upper portion of the pouch with a flowable material; forming a top sealed region closing the opening in the pouch; and removing a portion of the top sealed region.

The US20080313998 publication discloses an apparatus comprising: a film unwind station for unwinding a web of flexible film from a roll of film; a folding station for folding the web into a pair of opposing walls; a strip unwind station for unwinding a strip of semi-rigid material from a roll of material and positioning the strip between the pair of opposing walls of the web; a metal buffer plate insertable between the strip and one of the opposing walls of the web; a first sealing station having a sealing bar for forming a seal between the strip and the other of the opposing walls; a second sealing station having a pair of sealing bars positioned to form a lower non-linear side seal between the opposing walls of the web of flexible film at spaced intervals; a third sealing station having a pair of sealing bars positioned to form an upper non-linear side seal between the opposing walls of the web of flexible film at spaced intervals to define connected pouches between adjacent lower and upper side seals; a first cutting station provided to remove a portion of the lower side seal and a portion of the upper side seal, while the remainder of the side seals remain uncut and connected at an upper portion of the pouches; a separating station having a knife positioned to separate the connected pouches into separate individual pouches; a filling station having a reciprocally moveable filling tube insertable into the individual pouches through an opening in the pouch for filling the pouch with a flowable material; a fourth sealing station having a pair of sealing bars positioned to form a top seal in the pouch to close the opening; and a second cutting station provided to remove a portion of the top seal.

The present invention relates to an in-line method and apparatus to form and fill a flexible package and provides an option to eliminate the metal buffer plate at the first sealing station. This and other features of the invention will become apparent from the drawings and following detailed discussion, which by way of example without limitation describe preferred embodiments of the invention.

FIG. 1 is a schematic representation of a preferred embodiment of the invention showing modules of an apparatus 10 for forming and filling a flexible package. The apparatus 10 includes a forming stage 12 and a filling final stage 14. FIG. 1 shows an in-feed module (or unwind station) 22 that directs a web laminate film 56 and a semi-rigid materials strip 76 in a machine processing direction, to a first pouch forming or folding stage 24; a gusset-forming station 26 that folds the web laminate film 56 to the semi-rigid strip 76 so that the semi-rigid strip 76 is between a pair of opposing film walls, as hereinafter described in detail; and a rocker arm tacking station 28 that attaches the strip 76 to one of the pair of opposing walls.

Further apparatus 10 includes sealing station 30 with first sealing bar and sealing station 32 that sequentially seal opposing walls of the web of film 56 together at spaced sealing regions to form a pouch between the sealed regions. While the FIG. 1 shows two sealing stations 30, 32, the stations 30, 32 can represent any number of stations. For example in one embodiment, the sealing stations 30, 32 comprise a first sealing station having a sealing bar for forming a seal between the strip 76 and the other of the opposing walls, a second sealing station having a pair of sealing bars positioned to form a lower non-linear side seal between the opposing walls of the web of flexible film 56 at spaced intervals; and a third sealing station having a pair of sealing bars positioned to form an upper non-linear side seal between the opposing walls of the web of flexible film 56 at spaced intervals to define connected pouches between adjacent side seals.

Figure 5A:
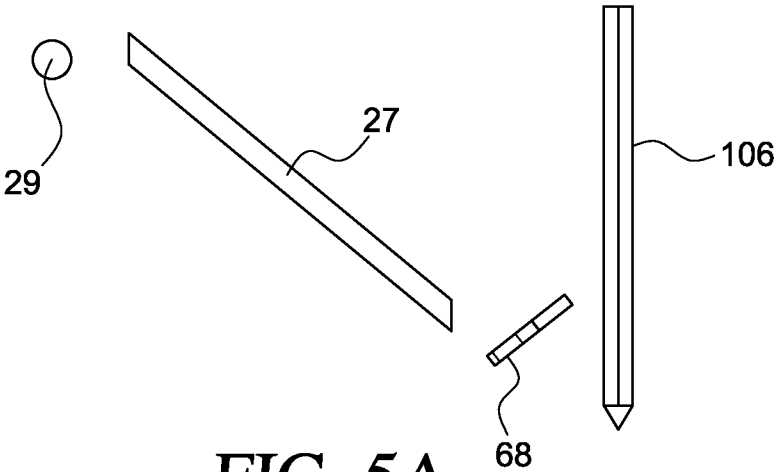
Figure 5B:
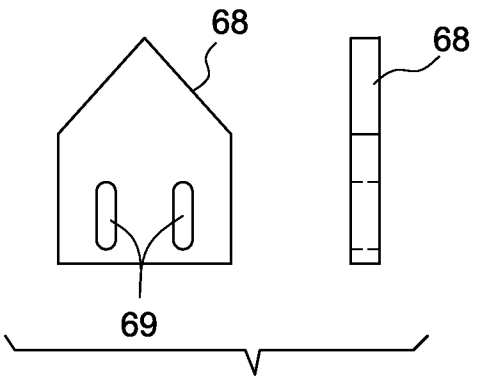
Figure 5C:
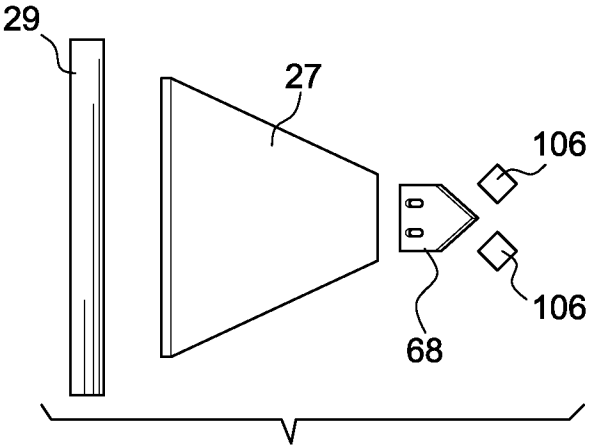
Figure 5D:
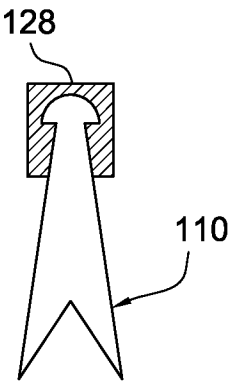

Further, the apparatus 10 includes first cooling station 34 and bottom die cutter 36 to form a pouch blank 110 (FIG. 5B). The bottom die cutter 36 can remove a portion of the lower side seal and a portion of the upper side seal, while the remainder of the side seals remain uncut and connected at an upper portion of the pouches. Feed roller 38 feeds the pouch blank 110 to filling final stage 14.

Filling final stage 14 includes inflating station 40 where the pouch is blown open, fill station 42 to fill the pouch with product, de-airing station 44 that removes air from the filled pouch, first top seal station 46 that applies a first seal, second top seal station 48 that applies a second seal, second cooling station 50 to cool the pouch and a second cutting station—top die cutter station 52 to cut top blank material from the pouch in the top seal area. FIG. 1 shows two sealing stations 46, 48. However, these stations 46, 48 can represent any number of sealing stations. For example in one embodiment, the sealing stations 46, 48 comprise a first sealing station having a sealing bar for forming a seal between the strip 76 and the other of the opposing walls, a second sealing station having a pair of sealing bars positioned to form a lower non-linear side seal between the opposing walls of the web of flexible film 56 at spaced intervals; and a third sealing station having a pair of sealing bars positioned to form an upper non-linear side seal between the opposing walls of the web of flexible film 56 at spaced intervals to define connected pouches between adjacent lower and upper side seals. At station 52, a pouch for forming a package, can be formed with narrowed neck and adjacent closed opening with taper toward an opening. Pick off area is shown as 54. A formed pouch can be removed from apparatus 10 at pick off area 10 and applied to a backing.

Figure 3:
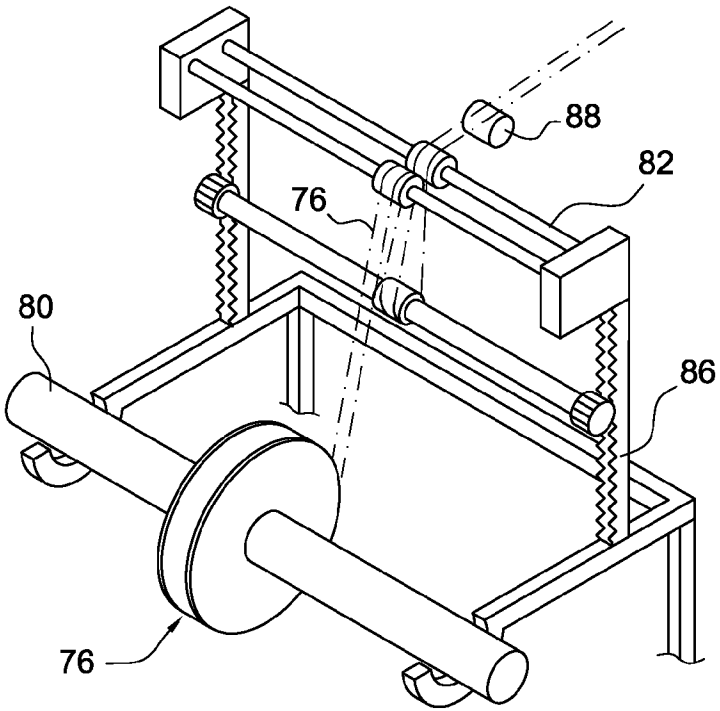
Figure 2:
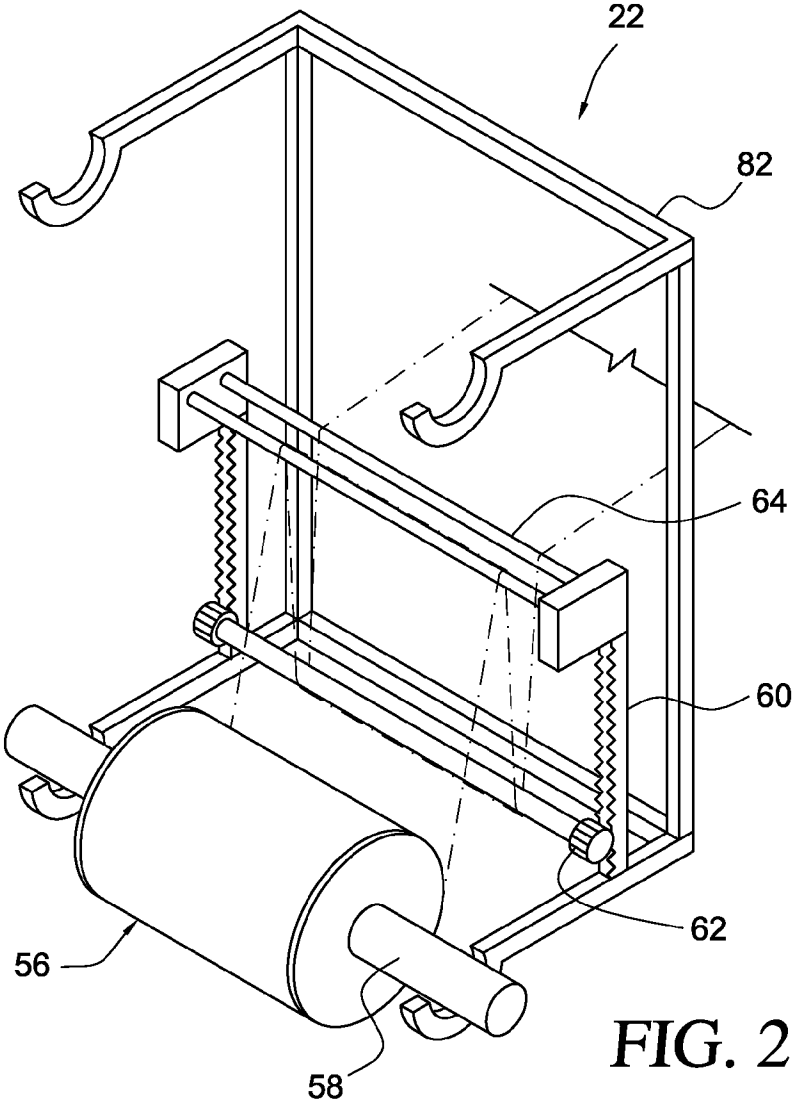

The apparatus 10 produces pouches from a continuous web of material. FIG. 2 and FIG. 3 show sections of in-feed module 22 of the apparatus 10. Referring to FIG. 1 and FIG. 2, a roll of web laminate 56 is rotatably connected by means of reel 58. The reel 58 is driven by the same motor (not shown) as the drive of reel 80 (hereinafter described) to apply the same tension to laminate 56 as to the semi-rigid material 76. The web 56 is fed from reel 58 via rack 60 that includes pinion 62 that is controlled by idler shaft 64 to apply a constant tension to rollers 66 and 88 (FIG. 1). The web 56 is threaded over the tension rollers 66 to first pouch forming stage 24 (FIG. 1) that includes plow assembly 68 (FIG. 5A) for folding the web to form pouch side panels joined at a common bottom edge.

In FIG. 3, shown is a spool of semi-rigid material strip 76. In one embodiment, the semi-rigid material strip 76 can be a high density polyethylene or preferably, a co-extrusion of metalocene and high density polyethylene. The semi-rigid material strip 76 is fed as a strip from reel 80 over idler 82 via rack and pinion assembly 86 via constant tension rollers 88 to first pouch forming stage 24 (FIG. 1). The reel 80 may be driven by an unwind motor (not shown) for driving the semi-rigid material strip 76 with web 56. In an embodiment, the rack and pinion 86 is fitted with a bottom relatively weak spring and the top of the rack and pinion 86 is pre loaded to bring idler 82 to an effective range.

Figure 4B:
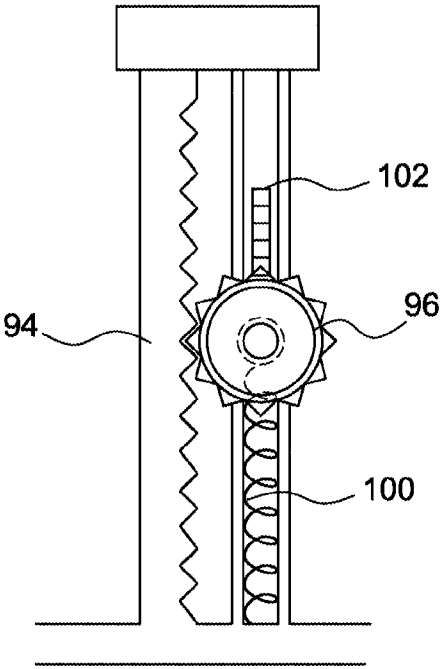
Figure 4A:
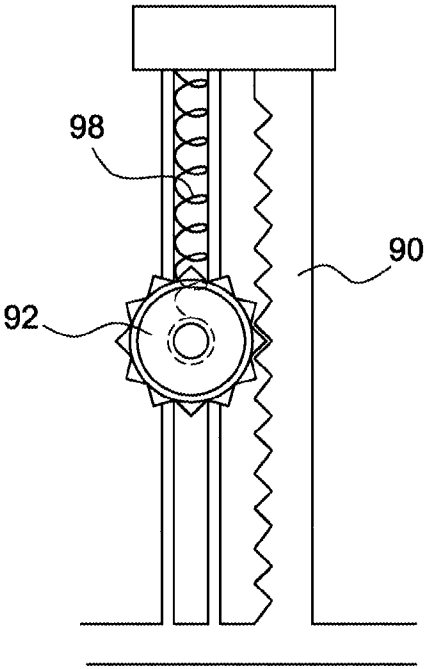

FIG. 4A shows a rack 90, pinion 92 to feed web laminate 56 and FIG. 4B shows a rack 94 and pinion 96 to feed semi-rigid material strip 76. Rack 90 and pinion 92 include downward biasing spring 98. The spring 98 loaded rack 94 bobs up and to down so that the feed roller 38 imparts a constant tension under periodic transient feed motion to web 56. Pinion 96 includes bottom ¾" biasing spring 100 (weak spring) that follows the periodic feed motion imparted to web 56. The pinion 96 is preloaded at the top with weights 102. The spring 100 and weights 102 combination biases the rack away from the material strip 76 to avoid a harsh backpressure tug on the feeding material strip 76.

Gusset-forming station 26 folds the web of film 56 to the semi-rigid strip 76 so that the semi-rigid strip is between a pair of opposing film walls; rocker arm tacking station 28 attaches the strip 76 to one of the pair of opposing film walls; sealing stations 30 and 32 sequentially seal opposing walls of the web of film together at spaced sealing regions to form pouches between the sealed regions; and first cooling station 34 and bottom die cutter 36 form a gusseted pouch blank. Feed roller 38 feeds the gusseted pouch blank to filling final stage 14. Filling final stage 14 includes inflating station 40 where a pouch is blown open, fill station 42 to fill the pouch with product, de-airing station 44 that removes air from the filled pouch, first top seal station 46 that applies a first seal, second top seal station 48, second cooling station 50 to cool the pouch, top die cutter station 52 to cut top blank material from the pouch to form a narrowed neck adjacent a first closure end of the pouch blank 110 and pick off area 54.

FIG. 5A shows functioning of gusset forming station 26 including HDPE idler 104, vertical crease bars 106 and gusset-forming plow 68. Web laminate 56 is oriented to the vertical so that imprinting on the web laminate 56 is to the top vertical. The strip 76 is twisted from horizontal feed to a vertical feed. The laminate 56 is then folded bottom to top against the strip 76 to form a pouch blank 110. The plow 68 then forms a W-shaped laminate bottom edge by supporting the pouch blank 110 at upper lines on either pouch blank side and imposing into a middle line between the lower supported lines to form a gusset shape or roughly W-shaped cross section. Then, the supported W-shape is creased through vertical crease bars 106 to form blank 110 shown in FIG. 5B.

Figure 6B:
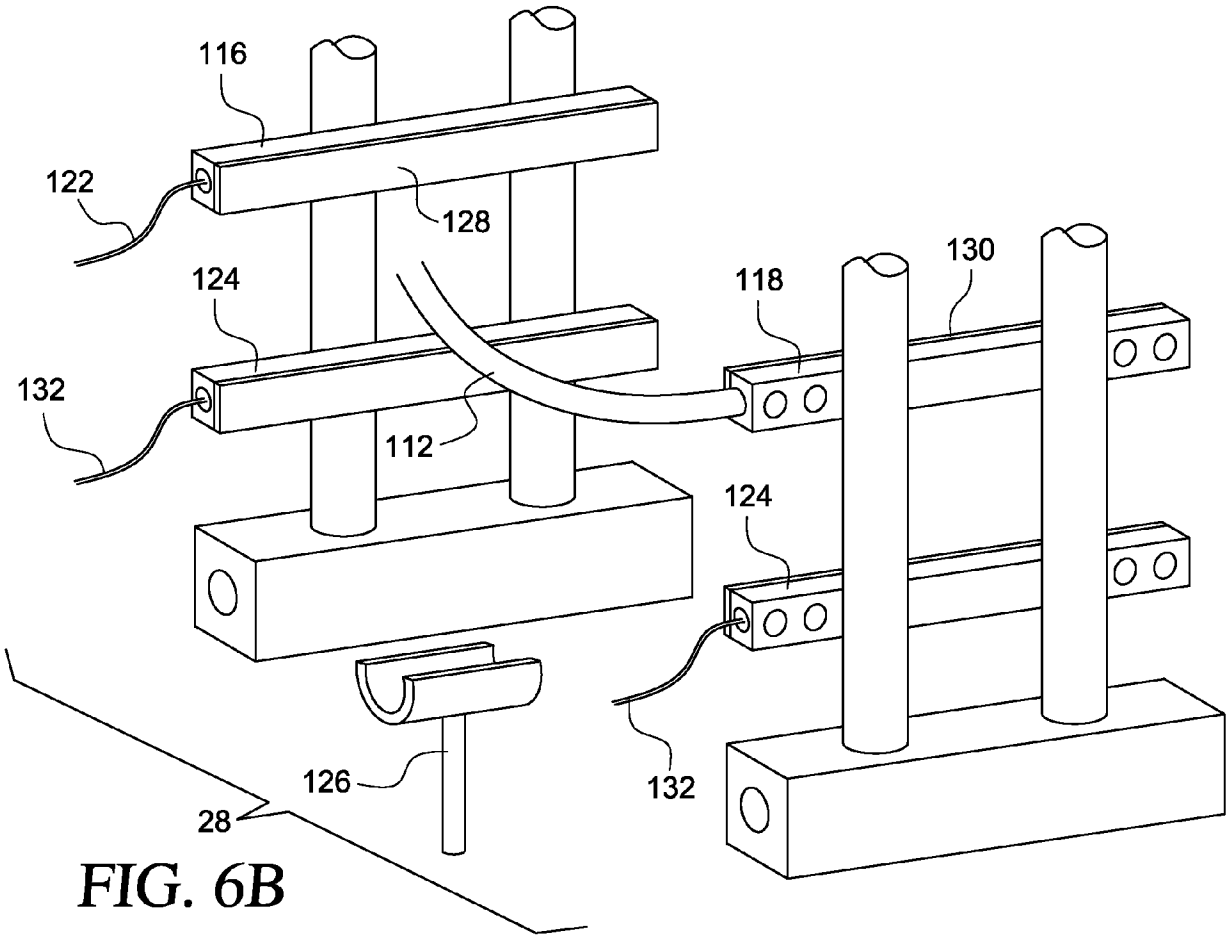
Figure 6A:
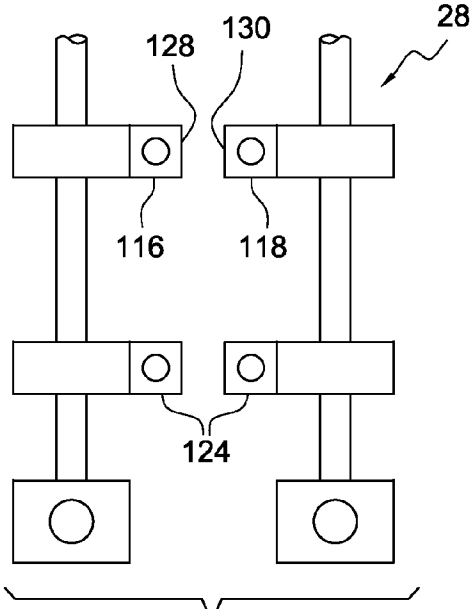

The FIG. 5B blank 110 next is conveyed to rocker arm tacking station 28 as shown in FIG. 6A. FIG. 6A is a side elevation view of the rocker arm tacking station 28 and FIG. 613 is an exploded, perspective view of the station and lower guide 126. In FIG. 6A and FIG. 6B, the station 28 includes upper heated bar 116 and upper cooler bar 118. A guide bar (not shown) can hold the blank semi-rigid strip 76 that forms blank 110 (FIG. 5B) for back side tacking to web laminate 56. Guide 126 maintains the pouch gusset and prevents web laminate 56 from sagging.

At this point in the US2008033998 method and apparatus, the semi-rigid strip is selectively sealed to one interior wall of the package but not the other so that later the formed package can be filled with material. US20080313998 accomplishes selective sealing by placing a metal buffer plate between the non-sealing surface side of the semi-rigid strip and an inner surface of one of the opposing walls, to separate one side of the opposing wall and the semi-rigid strip. Then upon applying sealing bars over the area of the strip, the metal buffer plate interferes with the sealing of that area and allows the two to remain unattached.

The invention station 28 of the current invention provides selective sealing that can eliminate the US2008033998 metal buffer plate or that can be used in conjunction with a plate to selectively attach the strip to only one of the opposing walls to define an opening between upper edges of the opposing walls. In the method, temperature, pressure of the upper cooling bars 116, 118 against edges of respective folded web laminate edges and controlled dwell time of the seal can be adjusted according to the material of the web laminate 56 and semi rigid material strip 76 to achieve a selective seal of one side of the web laminate 56 to the semi rigid strip 76 but not to the other. In the selective seal, one wall of laminate is heated to melt seal the wall to strip 76 while the opposing wall is maintained at a cooler temperature to prevent sealing to the other side of the strip 76 for providing the selectively sealed package.

In embodiments of the invention, the temperature differential between the heating bars 116 and 118 is determined by considering pressure and dwell time of the opposing bar faces 128, 130 of the bars and/or the temperature differential is determined by considering heat capacities and thicknesses of the web laminate and semi-rigid strip materials where specific heat capacity or specific heat is a measure of the heat energy required to increase the temperature of a unit quantity of a substance by a certain temperature interval.

In an example, a linear low density polyethylene (LLDPE), melting point 248° F., 0.009 to 0.10 mm thick material was used as the web laminate 56 material and an HDPE material, melting point 266° F., 0.008 to 0.10 mm thick (HDPE) was used as the semi-rigid strip 76. The tacking station 28 included lower gusset seal bars 124 (heated by electrodes 132) that sealed the lower gusseted end of the blank 110. Upper heating bar 116 was heated by heating electrode 122 (FIG. 6B) to about 319° F. Cool air from cooling tube 112 (FIG. 6B) blows on an inner side of the upper cool bar 118 to maintain one side of the cool bar 118 at approximately ambient (72° F.), a lower temperature than the approximate 319° F. heated side of the heated bar 116. Then, sealing of one wall to the laminate 56 is accomplished by selective heating and pressuring according to the heat capacities, thicknesses of the wall and strip and dwell time of the heating/cooling application In the example, the temperature differential between bars 116, 118 along with a tacking pressure (0.2 to 10.0 pounds/in$^2$) and dwell time (0.5 to 8 seconds), prevents the seal from entirely closing the blank so that the blank can be filled with product at a later station. In this embodiment, the heating bar 116 can be at a temperature from about 265° F. to about 340° F., preferably at a temperature from about 310° F. to about 330° F. and the temperature of bar 118 can be at a temperature from about 72° F. to about 100° F., preferably at about ambient.

In a method to form a squeezable package with adjusting relative temperatures at a rocker arm tacking station 28, a blank 110 is advanced through a sealing section of the apparatus 10 in which a number of pouch forming operations take place. FIG. 1 shows sealing section 30 and sealing section 32. The two sealing sections divide side seal tasks into two separate operations. This overcomes any problem with variation in the strip 76 location, which otherwise could result in an improper sealing of the web laminate 56 to the strip 76.

Referring again to FIG. 1, at cooling station 34, 40° C. water flows through sides of a cooling tool to properly cool blank 110 to allow shearing of web laminate 56. Blank 110 is shaped at bottom die cutter 36. The pouch blank 110 is inflated at inflation station 40 and filled with product at fill station 42. Here, vacuum suction cups can be applied to an outer surface of opposing walls of the pouch 110 to hold the pouch open while filling. Air is removed from the pouch blank 110 at deairing station 44. The blank 110 is top sealed at first top seal station 46 and second top seal station 48 and cooled at second cooling station 50. The hatched material 128 shown in FIG. 5B is removed from the blank 110 at top die cutter station 52.

Referring again to FIG. 1, the apparatus 10 provides a method for forming and filling a flexible package using an in-line process of the invention. The method comprises directing a web of film 56 and a semi-rigid strip 76 in a machine direction. At gusset forming station 26, the web of film 56 is folded to provide a pair of opposing front and back walls with the semi-rigid strip 76 there between. At rocker arm tacking station 28, the strip 76 is attached to one of the opposing walls and opposing walls of the web of film 56 are sealed together at spaced sealing regions to form pouches between the sealing regions. A section of the sealing regions at a lower portion is removed at bottom die cutter 36, to provide multiple pouches connected at an upper portion. The connected pouches are separated from the web of film 56 to provide an individual pouch. At fill station 42, an interior section of an individual pouch is filled with a flowable material through an opening in the upper portion of the pouch. At sealing stations 48 and 50, a top sealed region is formed, closing the opening in the pouch. A portion of the top sealed region is removed at die cutter station 52 to form a top tip section of the pouch. A pouch can be removed from the apparatus 10 at pick off station area 54.

In an embodiment, apparatus 10 can be used to produce a strip of multiple pouches. In this embodiment, a portion of sealed regions at a lower portion can be removed to provide multiple pouches connected by at an upper portion. The connected pouches can be separated at connecting web 56 to provide individual 14 pouches. Interiors of the individual pouches can be filled with flowable material through an opening in an upper portion of the pouch. Then, a top sealed region of the pouch can be closed and excess material removed from the top region by a die cutter to form a shaped spout area tapering toward the top sealed opening with a portion of the semi-rigid material strip adjacent the sealed opening to reinforce the opening.

Figure 7:
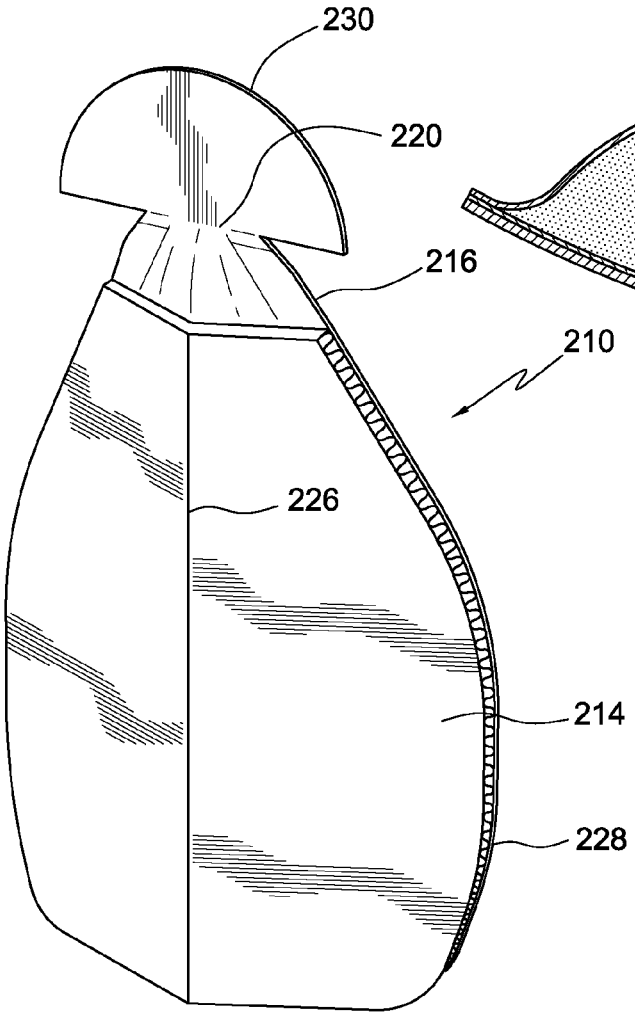
FIGS. 7 to 8 are schematic perspective views of a package, front and back.
Figure 9:
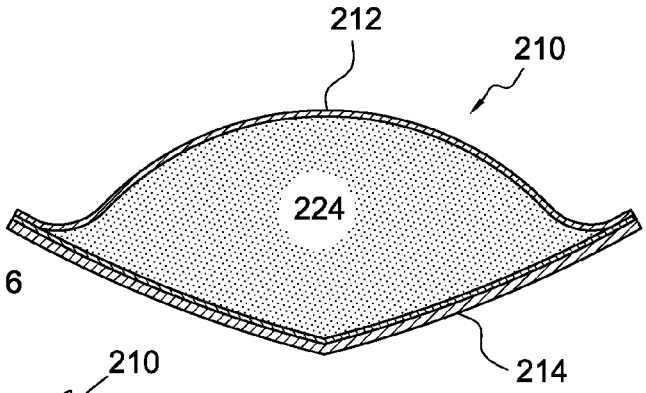
FIG. 9 is a cut-away view through A-A of the FIG. 8 package.
Figure 8:
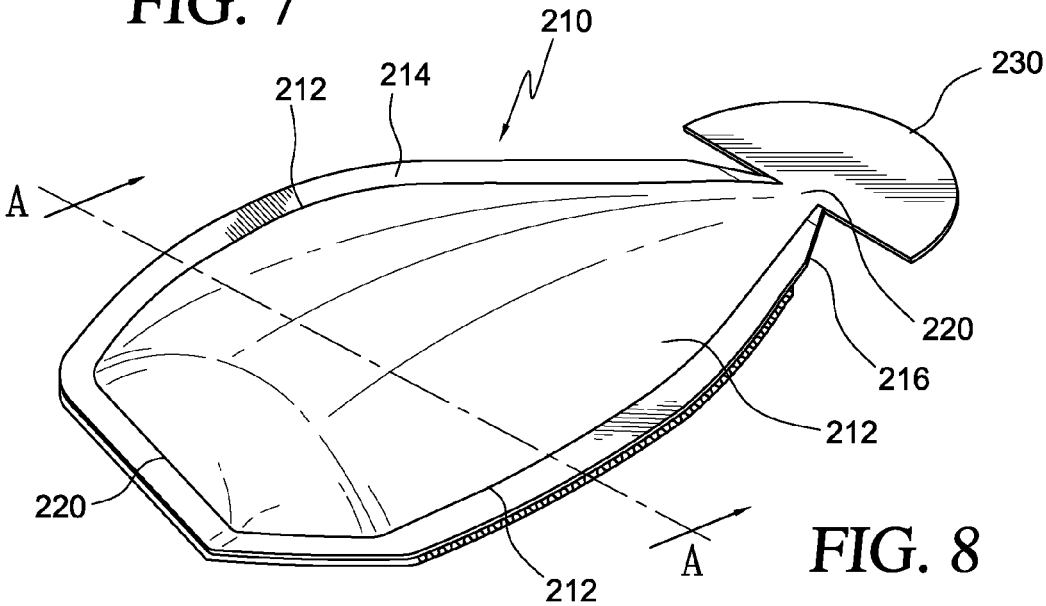

In an embodiment, a pouch produced by apparatus 10, can be applied to a flat or card and filled with a sealant such as a caulk, to form a package, for example, a flexible package according to FIGS. 7, 8 and 9. In this application, a "pouch" is a bag or container to hold material. A package" a packet or container bundle that may include a pouch. FIGS. 7 and 8 are schematic perspective views of a flexible package, front and back and FIG. 9 is a cut-away view through A-A of the FIGS. 7 and 8 flexible package. The figures show the flexible package 210 comprising a pouch 212 supported by a foldable flat 214. The size of fillable flexible package 210 can vary, but in some embodiments can be about 20±5 cm by 15±3 cm or smaller.

The tillable flexible package 210 comprises a pouch 212 of plastic or foil film formed from web laminate 56 in the forming method described above. The pouch 212 further includes flat 214 comprising a more rigid or thicker material than the pouch 212 film and a spout-forming area 216 on the rigid flat 214 side of the finable flexible package 210. The area 216 comprises a shaped semi-rigid material of intermediate thickness and rigidity between that of the material of the film 212 and the material of the pouch 214. The rigidity can be imparted from the section of semi-rigid strip 76 that is used in the forming process to tack web laminate 56. The strip 76 section is located at area 216 within the interior (not shown) of the pouch 212. In the embodiment shown in the figures, area 216 is trapezoidal-shaped with slanted sides from the rigid material sidewall toward the package tip end 220 that forms a tapered nozzle when folded or rolled with the rigid flat 214. In forming the package 210, the flat or "back card" 214, can be folded to bow the semi-rigid material 76 behind shaped area 216 to define an arcuate outlet adjacent an opening at the first closure end 220.

The finable package 210 further includes a semicircular-shaped tear tab 230 to facilitate opening at the tip 220. The top film 212 can be pleated 228 to allow for an increased volume of a sealant 224 and the bottom end 222 can comprise a gusset to accommodate an increased amount of fill material.

The pouch 212 can be heat-sealed or otherwise cradled to the flat 214 as shown in FIG. 9. A first closure end of pouch 212 forms an expressing shape tip 220. In FIGS. 7 and 9, the more rigid flat 214 has crease 226 that can be a fold or score running along the longitudinal axis of the more rigid flat 214 from tip 220 to a second closure end 222. The crease 226 is marked into the flat 214 surface to facilitate longitudinal folding of the tillable flexible package 210. The crease 226 can be a pressed, folded, wrinkled, embossed line or score. The crease 226 can run generally longitudinal to a long axis of the tillable flexible package 210 from one end of the tillable flexible package 210 toward the tip end 220. The crease 226 promotes longitudinal folding of opposite rigid flat sections against the pouch 222 to compress the pouch 212 to express sealant 224 from the pouch 212 interior. The more rigid flat 214 comprises a rigid or conformable surface that is configured to form cradling compression surfaces against pouch 212 when folded by a force applied to rigid flat 214 opposite sections. The more rigid flat 214 can be a flat comprising any material that is more inflexible or rigid than the pouch 212 material. An area 216 (from semi-rigid material strip 76) along a top interior portion of pouch 212 at area 216, comprises a shaped strip of intermediate thickness and rigidity between the material of the pouch 222 ansa the material of the flat 214.

Materials suitable for pouch 212 include single layer, co-extruded or laminated film or foil. Preferably the material has a permeability rating of 1 or lower. Suitable film materials include a plastic film, such as low-density polyethylene or other thermoplastic or foil film material such as polypropylene, polystyrene or polyethylene-terephthalate. The foil is a thin, flexible leaf or sheet of metal such as aluminum foil for example. In one embodiment, the film is a polyethylene and bi-oriented polypropylene co-extruded film. An aluminum foil is a preferred pouch 12 film material. Suitable foil can be derived from aluminum prepared in thin sheets 16 with a thickness less than 0.2 mm/0.008 in, although much thinner gauges down to 0.006 mm can be used. A suitable foil can comprise a laminate with other materials such as a plastic or paper.

The pouch 212 material can be impermeable or only slightly permeable to water vapor and oxygen to assure content viability. For example, the film can have a moisture vapor transport rate (MVTR, ASTM D3833) of less than 10 g/day/$m^2$. In an embodiment, the MVTR of the film is less than 5 g/day/$m^2$ and preferably less than 1 g/day/m2 and most preferably of less than 0.5 g/day/$m^2$. The pouch 212 film can be of various thicknesses. The film thickness can be between 10 and 150 μm, preferably between 15 and 120 μm, more preferably between 20 and 100 μm, even more preferably between 25 and 80 μm and most preferably between 30 and 40 μm. In an embodiment, the pouch 212 comprises a bi-axle oriented nylon (print layer), adhesive and a PET layer adhered to a liner low density polyethylene film.

While preferred embodiments of the invention have been described, the present invention is capable of variation and modification and therefore should not be limited to the precise details of the examples. The invention includes changes and alterations that fall within the purview of the following claims.

What is claimed is:

1. An in-line method of forming and filling a flexible package, comprising:

determining heat capacity and thickness of a flexible film and heat capacity and thickness of a semi-rigid strip, directing a web of the film and the semi-rigid strip in a machine direction;

folding the web of film to match web edge sections against respective sides of the semi-rigid strip to form a pair of opposing walls with the semi-rigid strip there between;

determining a differential of pressure and temperature to apply to respective web edge sections to seal one edge section but not an other edge section of the pair of opposing walls; and attaching the strip to only one of the edge sections of the pair of opposing walls by controlling directly applied differential heating and pressure according to the determined differential heat capacities and thicknesses, without an intervening buffer plate, to opposing walls of the pair to selectively seal one wall but not the other to the semi-rigid strip to define an opening between upper edges of the opposing walls.

2. The method of claim 1, comprising controlling according to pressure and dwell time of opposing faces of heating bars that seal the opposing walls.

3. The method of claim 1, comprising identifying melt temperature of the web of film and selectively attaching the strip to only one of the opposing walls by controlling heating to the identified melt temperature of one of opposing walls of the pair to define an opening between upper edges of the opposing walls.

4. The method of claim 1, comprising sealing the opposing walls of the web of film together at spaced sealing regions to form pouches with open tops between the sealing regions.

5. The method of claim 1, further comprising removing a portion of the top sealed region to form a narrowed neck adjacent the closed opening.

6. The method of claim 1, wherein the semi-rigid strip is high density polyethylene and the web of film is linear low density polyethylene.

7. The method of claim 1, further including a step of forming a gusseted bottom.

8. The method of claim 1 wherein temperature applied to one wall is about 265° F. to about 340° F. and to the opposing wall is 72° F. to about 100° F.

9. The method of claim 1 wherein temperature applied to one wall is about 310° F. to about 330° F. and to the opposing wall is at about ambient.

10. The method of claim 1, wherein the semi-rigid strip is high density polyethylene and the web of film is linear low density polyethylene.

11. The method of claim 1 wherein temperature applied to one wall is about 265° F. to about 340° F. and to the opposing wall is 72° F. to about 100° F.

12. The method of claim 1 wherein temperature applied to one wall is about 310° F. to about 330° F. and to the opposing wall is at about ambient.

13. A method of forming and filling a squeezable package, the method comprising: determining heat capacity and thickness of a flexible film and of a semi-rigid strip, directing the web of flexible film and the semi-rigid strip in a machine direction; folding the web of film to have a pair of opposing walls having a front wall and a back wall and positioning the strip between the front and back wall;

adjusting temperature and pressure according to the determined heat capacities and thicknesses, to directly apply differential heating and pressure without an intervening buffer plate, to selectively seal one opposing wall to the strip but not the other to form an opening; forming a lower non-linear side seal between the opposing walls in the web of flexible film;

forming an upper non-linear side seal between the opposing walls in the web of flexible film partially coextensive with the lower side seal;

removing a first non-linear section in a lower portion of the web of film to provide multiple pouches connected at an upper portion thereof;

separating the connected pouches from the web of film at the upper portion to provide an individual pouch with an upper opening;

filling an interior section of the individual pouch through the opening in the upper portion of the pouch with a flowable material;

forming a top seal to close the opening; and removing a second non-linear section in the upper portion of the pouch to form the squeezable package having a narrower upper portion than lower portion.

14. The method of claim 13, comprising controlling according to pressure and dwell time of opposing faces of heating bars that seal the opposing walls.

15. The method of claim 13, comprising identifying melt temperature of the web of film and selectively attaching the strip to only one of the opposing walls by controlling heating to the identified melt temperature of one of opposing wails of the pair to define an opening between upper edges of the opposing walls.

16. An apparatus for in-line forming and filling a flexible package, comprising:

a film unwind station for unwinding a web of flexible film from a roll of film;

a folding station for folding the web into a pair of opposing walls;

a strip unwind station for unwinding a strip of semi-rigid material from a roll of material and positioning the strip between the pair of opposing walls of the web; and a sealing station comprising a first pressure, dwell time and temperature controlled seal bar and a second pressure, dwell time and temperature controlled seal bar opposing the first seal bar and controlled at a different combination of pressure, dwell time and temperature to selectively seal without intervening buffer, plate, one of the pair of opposing walls with the strip but not the other wall.

17. The apparatus of claim 16, comprising a pair of sealing bars wherein one bar is heated to a temperature between 265° F. to about 330° F. and the opposing is controlled at 72° F. to about 100° F.

* * * * *